US008438807B1

(12) United States Patent
Cornwall

(10) Patent No.: US 8,438,807 B1
(45) Date of Patent: May 14, 2013

(54) FIRESTOP DRAIN ASSEMBLY

(76) Inventor: Kenneth R. Cornwall, Duluth, GA (US)

( * ) Notice: Subject to any disclaimer, the term of this patent is extended or adjusted under 35 U.S.C. 154(b) by 0 days.

(21) Appl. No.: 13/470,601

(22) Filed: May 14, 2012

Related U.S. Application Data

(60) Division of application No. 12/332,585, filed on Dec. 11, 2008, now Pat. No. 8,191,330, which is a continuation-in-part of application No. 12/272,055, filed on Nov. 17, 2008, now abandoned.

(51) Int. Cl.
*E04B 1/70* (2006.01)

(52) U.S. Cl.
USPC ..... 52/302.1; 52/220.8; 52/232; 4/288

(58) Field of Classification Search ..... 52/232, 52/220.8, 302.1; 4/288, 286
See application file for complete search history.

(56) References Cited

U.S. PATENT DOCUMENTS

| | | | | | |
|---|---|---|---|---|---|
| 2,748,871 | A * | 6/1956 | Brown | 166/129 |
| 2,973,036 | A * | 2/1961 | Brown | 166/313 |
| 3,356,142 | A * | 12/1967 | Crow et al. | 166/134 |
| 4,646,486 | A * | 3/1987 | Hauff | 52/1 |
| 5,299,836 | A * | 4/1994 | Woods | 285/42 |
| 5,309,688 | A * | 5/1994 | Robertson | 52/220.8 |
| 5,347,767 | A * | 9/1994 | Roth | 52/1 |
| 5,732,176 | A * | 3/1998 | Savage, Jr. | 385/92 |
| 5,953,872 | A * | 9/1999 | MacMillian et al. | 52/220.8 |
| 6,336,297 | B1 * | 1/2002 | Cornwall | 52/232 |
| 6,363,544 | B1 * | 4/2002 | Ryan | 4/287 |
| 6,405,502 | B1 * | 6/2002 | Cornwall | 52/220.8 |
| 6,470,635 | B2 * | 10/2002 | Cornwall | 52/220.8 |
| 6,643,985 | B2 * | 11/2003 | Munzenberger | 52/232 |
| 6,679,015 | B1 * | 1/2004 | Cornwall | 52/232 |
| 6,694,684 | B2 * | 2/2004 | Radke et al. | 52/232 |
| 6,792,726 | B1 * | 9/2004 | Price | 52/220.8 |
| 6,862,852 | B1 * | 3/2005 | Beele | 52/220.8 |
| 7,018,699 | B2 * | 3/2006 | Dykhoff | 428/76 |
| 7,065,924 | B2 * | 6/2006 | Wade | 52/16 |
| 7,080,486 | B2 * | 7/2006 | Radke et al. | 52/98 |
| 2002/0032996 | A1 * | 3/2002 | Cornwall | 52/220.8 |
| 2002/0056242 | A1 * | 5/2002 | Andresen | 52/220.8 |
| 2003/0051423 | A1 * | 3/2003 | Munzenberger | 52/220.8 |
| 2003/0167712 | A1 * | 9/2003 | Robertson | 52/232 |
| 2003/0172603 | A1 * | 9/2003 | McKesson | 52/232 |
| 2004/0010980 | A1 * | 1/2004 | Cornwall | 52/1 |
| 2004/0016190 | A1 * | 1/2004 | Radke et al. | 52/232 |
| 2004/0149390 | A1 * | 8/2004 | Monden et al. | 156/391 |
| 2006/0000165 | A1 * | 1/2006 | Robertson | 52/232 |

* cited by examiner

*Primary Examiner* — Brian Glessner
*Assistant Examiner* — Joshua Ihezie
(74) *Attorney, Agent, or Firm* — Mary M. Moyne; Fraser Trebilcock

(57) ABSTRACT

A firestop drain assembly for mounting in a partition to prevent fire on one side of the partition from moving through the firestop drain assembly to the other side of the partition. The firestop drain assembly can achieve an F-rating and a T-rating of at least one (1) hour.

21 Claims, 5 Drawing Sheets

FIRESTOP DRAIN ASSEMBLY

CROSS REFERENCES TO RELATED APPLICATIONS

This is a division of U.S. application Ser. No. 12/332,585 filed Dec. 11, 2008 which is a continuation-in-part of U.S. application Ser. No. 12/272,055 filed on Nov. 17, 2008 now abandoned which are hereby incorporated herein by reference in their entirety, except that the present application supersedes any portion of the above referenced applications which are inconsistent with the present application.

STATEMENT REGARDING FEDERALLY SPONSORED RESEARCH OR DEVELOPMENT

Not Applicable

BACKGROUND OF THE INVENTION (1) Field of the Invention

The present invention relates to a firestop drain assembly for use in a partition to prevent fire from moving through the partition. In particular, the present invention relates to a firestop drain assembly which prevents fire from moving through the partition before the temperature of the strainer increases above acceptable temperatures.

(2) Description of Related Art

In the past, floor drains were unable to achieve the F-rating and T-rating required by national building codes. Building codes require that through penetrations shall be protected by an approved through penetration firestop system or device installed and tested in accordance with the ASTM E-814 fire test standard. The device or system must have an F-rating and a T-rating of not less than one (1) hour but not less than the required rating of the partition. For floor and shower drains, the temperature of the floor or shower drain top or strainer cannot exceed 325° F. (163° C.) above the initial temperature and achieve the required T-rating. In the past, metallic drain tops have transmitted too much heat and have obtained a zero (0) T-rating. There remains a need for a firestop drain assembly which can obtain the required T-rating and comply with the national building codes.

BRIEF SUMMARY OF THE INVENTION

A firestop drain assembly for mounting in a partition to prevent fire on one side of the partition from moving through the firestop drain assembly to the other side of the partition. The firestop drain assembly includes a drain, a base, a firestop extension, and a drain pipe. The drain is mounted in one end of the base and the firestop extension is mounted on the other end of the base. The drain pipe is mounted in the inner passageway of the base and extends downward through the firestop extension. The firestop drain assembly is mounted in the partition such that the drain is adjacent the one side of the partition and the firestop extension extends outward beyond the other side of the partition. The configuration of the base depends on the type of partition in which the firestop drain assembly is to be used. The firestop extension includes a housing with firestop material mounted in the inner passageway of the housing. The firestop material is mounted at the second end of the housing opposite the base. The length of the firestop extension is such that the firestop extension extends beyond the partition. In one (1) embodiment, the firestop extension extends at least approximately 3.0 inches (76.2 mm) beyond the partition. In one (1) embodiment, the length of the firestop extension is such that the firestop material is located completely beyond the partition. The drain pipe extends through the firestop extension and is connected to the drainage system. The size of the housing of the firestop extension and the size and thickness of the firestop material is such that the firestop material is spaced apart from the drain pipe.

The firestop drain assembly is mounted in a partition and prevents fire on one side of the partition from moving through the firestop drain assembly to the other side of the partition. The firestop drain assembly also prevents fire adjacent the second side of the partition from raising the temperature of the strainer of the drain above acceptable temperature levels. When heat from a fire adjacent the one side of the partition contacts the firestop extension and the drain pipe, the heat causes the firestop material to expand and fill the inner passageway of the housing of the firestop extension. The heat of the fire also softens or melts the drain pipe adjacent the fire including the portion of the drain pipe in the inner passageway of the housing of the firestop extension. The size and rate of expansion of the firestop material prevents the firestop material from contacting the drain pipe until the fire has sufficiently softened the drain pipe so that the expanding firestop material can crush the portion of the drain pipe located in the inner passageway of the housing of the firestop extension and completely close the inner passageway of the firestop drain assembly to prevent the fire from moving through the firestop drain assembly. The construction and size of the housing for the firestop extension, as well as the size and type of firestop material used, ensures that the drain pipe will soften before the firestop material contacts the drain pipe so that the firestop material can crush the drain pipe to completely block the firestop drain assembly. During a fire, the firestop drain assembly prevents the strainer of the drain from increasing in temperature more than approximately 325° F. (163° C.) above an ambient temperature of the strainer. When mounted in a concrete partition, the firestop drain assembly can achieve an F-rating and a T-rating of at least one (1) hour.

The present invention relates to a firestop drain assembly for use in a partition, which comprises a base configured to be mounted in the partition, a strainer connected to the base, a firestop extension housing having opposed first and second ends with an inner passageway extending therebetween, and connected at the first end to the base and extending outward from the base to the second end in a direction opposite the strainer, firestop material mounted in the inner passageway of the firestop extension housing adjacent the second end of the firestop extension housing, wherein, in use, when the base is mounted in the partition, the firestop extension housing has a length between the first and second ends such that the firestop material is located beyond the partition in the direction opposite the strainer, and a drain pipe connected to the base and extending outward from the base through the inner passageway of the firestop extension housing and beyond the second end of the firestop extension housing in the direction opposite the strainer.

Further, the present invention relates to a method of preventing fire adjacent a first side of a partition from moving through a drain mounted in the partition to a second side of the partition, which comprises the steps of providing the drain having a base configured to be mounted in the partition with a strainer connected to the base, a firestop extension housing having opposed first and second ends with an inner passageway extending therebetween connected at the first end to the base and extending outward from the base to the second end in a direction opposite the strainer, firestop material mounted adjacent the second end of the firestop extension housing in the inner passageway of the firestop extension housing, and a drain pipe connected to the base and extending outward from the base through the inner passageway of the firestop extension housing and beyond the second end of the firestop extension housing in the direction opposite the strainer, mounting the base in the partition so that the strainer is adjacent the second side of the partition and the second end of the firestop extension housing extends beyond the first side of the partition so that the firestop material is positioned beyond the first side of the partition, and exposing the first side of the partition to the fire so that a portion of the drain pipe located in the inner passageway of the firestop extension housing melts and the firestop material adjacent the second end of the firestop extension housing expands, wherein an initial thickness of the firestop material and a rate of expansion of the firestop material is such that the firestop material contacts the portion of the drain pipe after the portion of the drain pipe has melted sufficiently so that when the firestop material contacts the portion of the drain pipe, the firestop material crushes the portion of the drain pipe and seals the inner passageway of the firestop extension housing before the fire on the first side of the partition raises a temperature of the strainer to greater than approximately 325° F. (163° C.) above an ambient temperature of the strainer.

The substance and advantages of the present invention will become increasingly apparent by reference to the following drawings and the description.

DETAILED DESCRIPTION OF THE INVENTION

Figure 1:
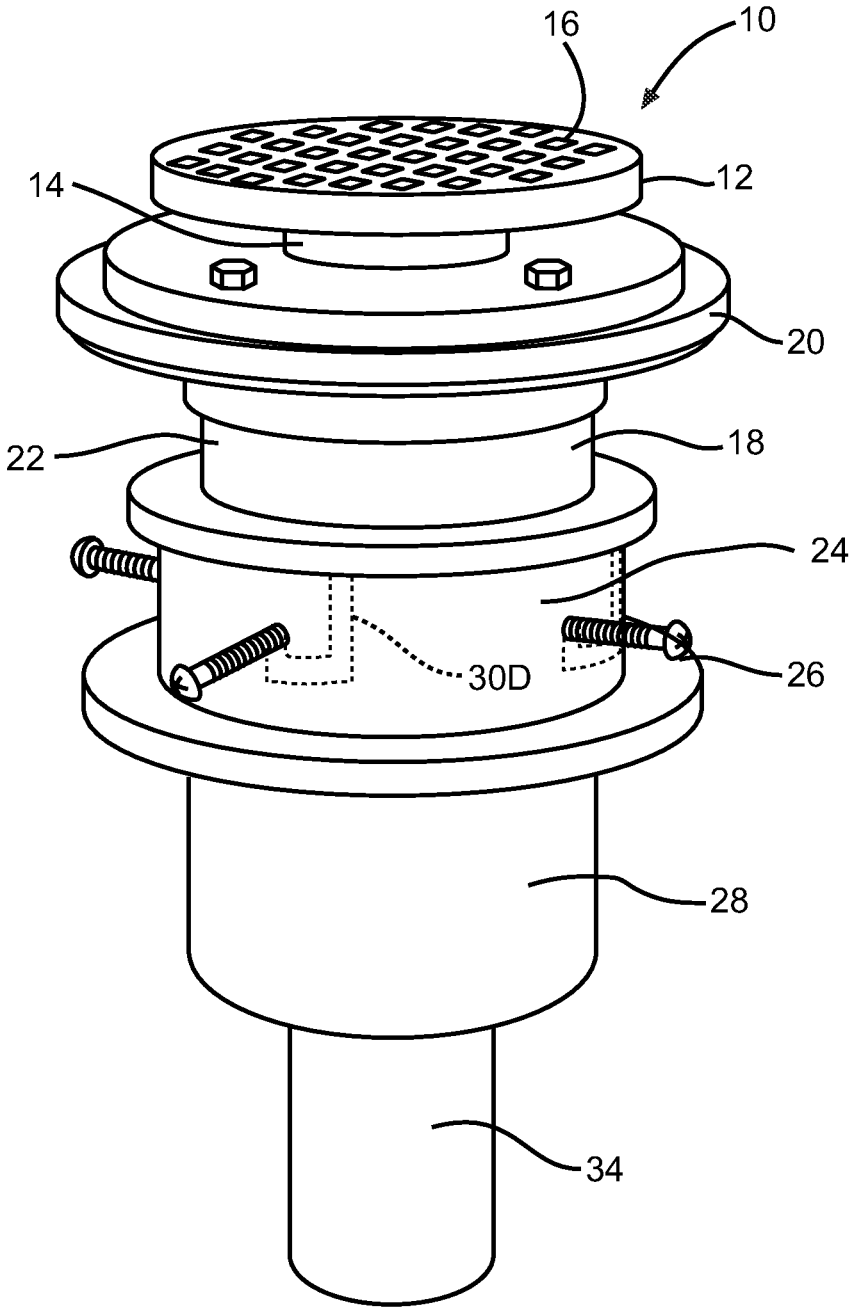
FIG. 1 is a perspective view of a first embodiment of the firestop drain assembly 10 showing the fasteners 26.

FIGS. 1 to 4 show the firestop drain assembly 10, 210 and 310 of the present invention. The firestop drain assembly 10, 210 and 310 includes a drain 12, a base 18, 218 and 318, a firestop extension 28, 228 and 328, and a drain pipe 34. The firestop drain assembly 10, 210 and 310 is intended to be mounted in a partition. In one (1) embodiment, the partition is a floor 100, 200 and 300. However, it is understood that the firestop drain assembly 10, 210 and 310 can be used in any type of partition in which a drain assembly is needed. In one (1) embodiment, the firestop drain assembly 10, 210 and 310 is a floor drain. In another embodiment, the firestop drain assembly 10 is a shower drain.

The drain 12 includes a drain housing 14 and a strainer 16. The drain housing 14 has an open, first end 14A and an open, second end 14B with an inner passageway extending therebetween. The drain top or strainer 16 is mounted in the open, first end 14A of the drain housing 14. In one (1) embodiment, the drain housing 14 is constructed of metal. In one (1) embodiment, the strainer 16 is constructed of metal. In one (1) embodiment, the strainer 16 is constructed of brass, nickel or bronze. However, it is understood that the drain housing 14 and strainer 16 can be constructed of any metal well known in the art for constructing drains. The second end 14B of the drain housing 14 is mounted in the base 18, 218 and 318. In one (1) embodiment, the drain housing 14 is adjustably and removably mounted in the base 18, 218 and 318. In one (1) embodiment, the drain housing 14 is fixably and permanently mounted in the base 18, 218 and 318.

Figure 2:
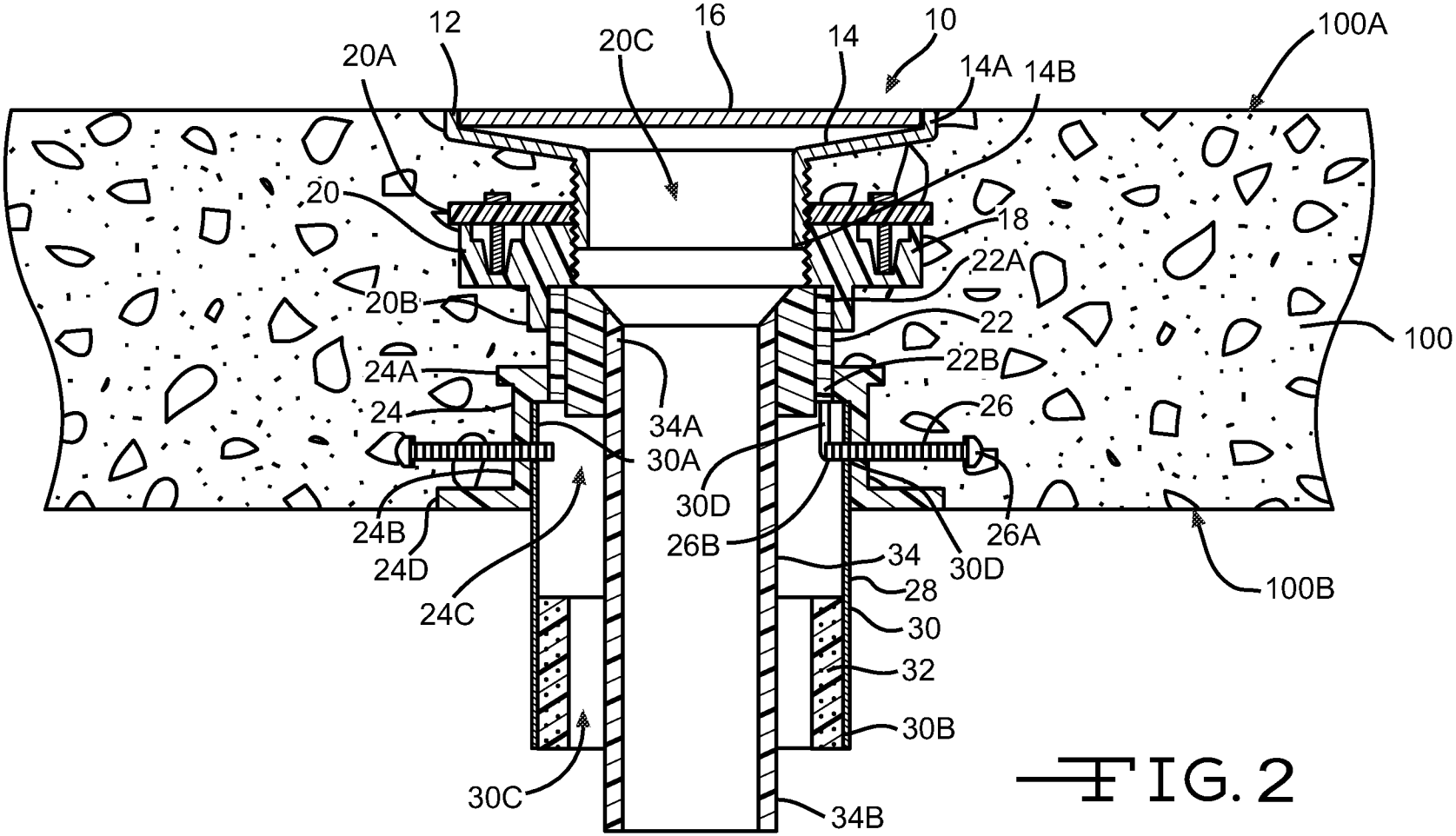
FIG. 2 is a crossectional view of the first embodiment of the firestop drain assembly 10 mounted in a wood form, concrete floor 100.

The configuration of the base 18, 218 and 318 of the firestop drain assembly 10, 210 and 310 depends on the type of partition in which the firestop drain assembly 10, 210 and 310 is to be used. In a first embodiment, the firestop drain assembly 10 is used in a wood form, concrete floor 100 (FIG. 2). In this embodiment, the base 18 includes a mounting flange 20, a coupling sleeve 22, and a coupling 24. The mounting flange 20 has opposed first and second ends 20A and 20B with an inner passageway 20C extending therebetween. The second end 14B of the drain housing 14 is mounted in the first end 20A of the mounting flange 20. In one (1) embodiment, the inner passageway 20C of the mounting flange 20 adjacent the second end 20B of the mount flange 20 is threaded. In this embodiment, the drain housing 14 has threads which engage the threads of the mounting flange 20. The threaded mating of the drain housing 14 and the mounting flange 20 allows for adjusting the height of the drain 12 to accommodate partitions 100 or floors having different thicknesses. In one (1) embodiment, the mounting flange 20 is similar to the mounting flanges well known in the art for mounting drains 12. The mounting flange 20 is connected to the coupling sleeve 22. The coupling sleeve 22 has opposed first and second ends 22A and 22B with an inner passageway extending therebetween. The first end 22A of the coupling sleeve 22 is mounted in the open, second end 20B of the mounting flange 20. The second end 22B of the coupling sleeve 22 is connected to the coupling 24. The coupling 24 has an open, first end 24A and an open, second end 24B with an inner passageway 24C extending therebetween. The second end 22B of the coupling sleeve 22 is mounted in the open, first end 24A of the coupling 24. In one (1) embodiment, the size of the inner passageway 24C of the coupling 24 adjacent the second end 24B is greater than the size of the inner passageway 24C of the coupling 24 adjacent the first end 24A such that a shoulder is formed in the inner passageway 24C of the coupling 24 adjacent the first end 24A. The coupling 24 has an outer flange 24D adjacent the second end 24B which enables the base 18 to be mounted to the wood form (not shown) during pouring of the concrete floor 100. In one (1) embodiment, the coupling 24 has a ring adjacent the first end 24A which allows the coupling 24 to be securely mounted in the concrete floor 100. The coupling 24 is provided with fasteners 26 having opposed ends 26A and 26B. The fasteners 26 extend through the coupling 24 so that the second end 26B of the fasteners 26 extends into the inner passageway 24C of the coupling 24 adjacent the second end 24B of the coupling 24. The first end 26A of the fasteners 26 extend outward from the coupling 24 into the concrete floor 100 so that the fasteners 26 are locked in position by the concrete floor 100. In one (1) embodiment, the fasteners 26 have a length of approximately 2.0 inches (50.8 mm). In one (1) embodiment, the fasteners 26 are sheet metal screws. In one (1) embodiment, the fasteners 26 are approximately 8×2 inch sheet metal screws. In one (1) embodiment, the coupling 24 is essentially cylindrical and the fasteners 26 are spaced apart approximately 90° around the coupling 24. The fasteners 26 enable the firestop extension 28 to be mounted in the base 18, after the concrete of the floor 100 has been poured (FIG. 2).

Figure 3:
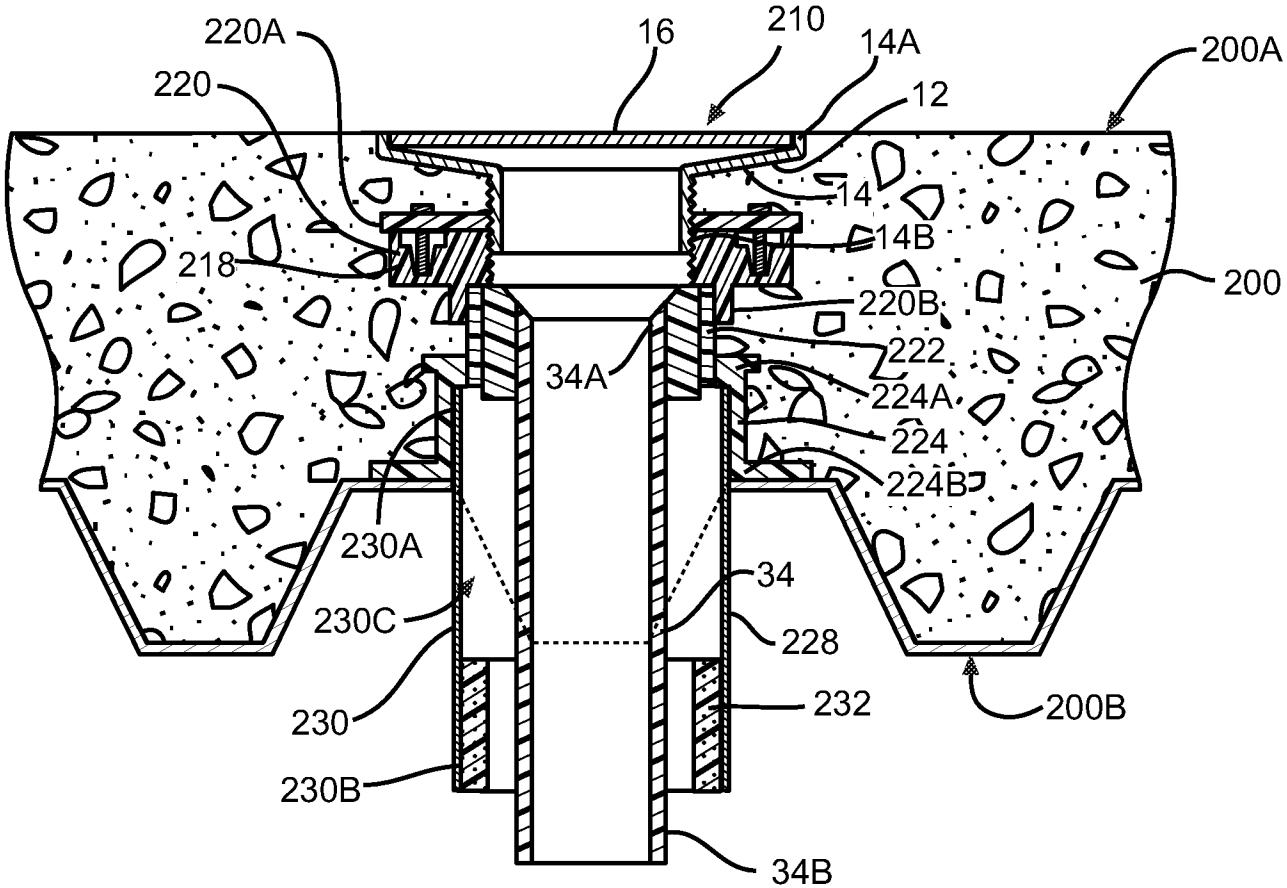
FIG. 3 is a crossectional view of a second embodiment of the firestop drain assembly 210 mounted in a corrugated metal, concrete floor 200.

In a second embodiment, the firestop drain assembly 210 is mounted in a corrugated metal, concrete floor 200 (FIG. 3). In this embodiment, the base 218 is similar to the first embodiment and includes a mounting flange 220, a coupling sleeve 222, and a coupling 224. Similar to the first embodiment, the drain 12 is mounted in the open, first end 220A of the mounting flange 220 of the base 218. The first end 222A of the coupling sleeve 222 is mounted in the second end 220B of the mounting flange 220 and the second end 222B of the coupling sleeve 222 is mounted in the first end 224A of the coupling 224. The coupling 224, of this embodiment, is similar to the coupling 24 of the first embodiment, except that the firestop extension 228 is mounted to the coupling 224 before the base 218 is mounted into the concrete floor 200.

Figure 4:
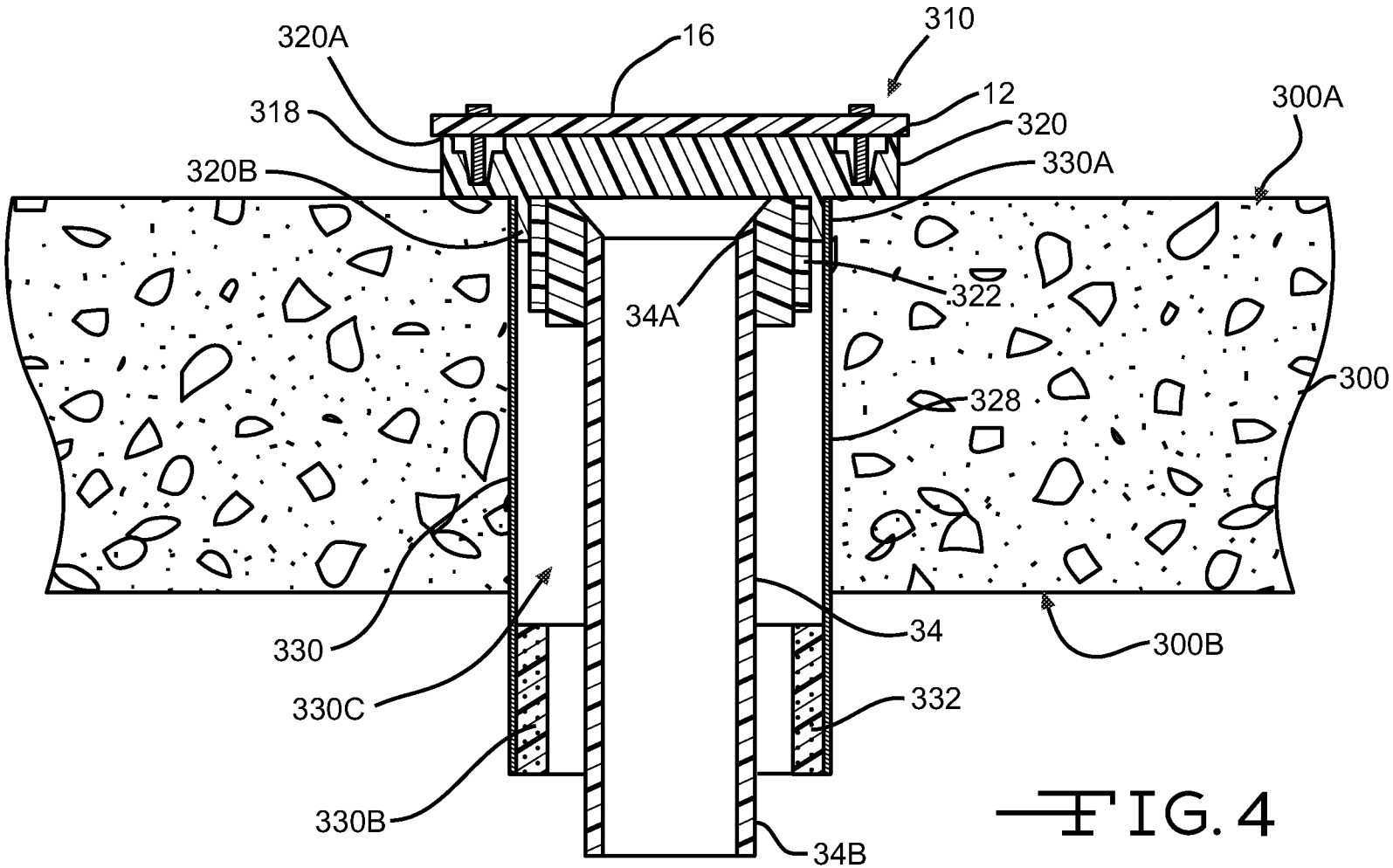
FIG. 4 is a crossectional view of a third embodiment of the firestop drain assembly 310 mounted in a precast, concrete floor 300.

In a third embodiment, the firestop drain assembly 310 is used in a cored hole in a concrete floor 300 (FIG. 4). In this embodiment, the base 318 includes a mounting flange 320 and a coupling sleeve 322. The mounting flange 320 is positioned on the one side 300A of the floor 300. Similar to the first and second embodiments, the drain 12 is mounted in the open, first end 320A of mounting flange 320. The coupling sleeve 322 is mounted in the open, second end 320B of the mounting flange 320 and extends through the cored hole in the floor 300. In this embodiment, the firestop extension 328 is also connected to the second end 320B of the mounting flange 320 opposite the drain 12 and extends through the cored hole in the floor 300. In one (1) embodiment, the first end 330A of the housing 330 of the firestop extension 328 is mounted on the outer surface of the second end 320B of the mounting flange 320.

The firestop extension 28, 228 and 328 includes a housing 30, 230 and 330 and firestop material 32, 232 and 332. The housing 30, 230 and 330 has opposed first and second ends 30A, 30B, 230A, 230B, 330A and 330B with an inner passageway 30C, 230C and 330C extending therebetween. In one (1) embodiment, the housing 30, 230 and 330 has an essentially cylindrical shape so that the inner passageway 30C, 230C and 330C of the housing 30, 230 and 330 has an essentially cylindrical shape. The first end 30A, 230A and 330A of the housing 30, 230 and 330 is connected to the base 18, 218 and 318. The firestop material 32, 232 and 332 is mounted in the inner passageway 30C, 230C and 330C of the housing 30, 230 and 330 adjacent the second end 30B, 230B and 330B of the housing 30, 230 and 330. In one (1) embodiment, the second end 30B, 230B and 330B of the housing 30, 230 and 330 is bent inward into the inner passageway 30C, 230C and 330C to secure the firestop material 32, 232 and 332 in the second end 30B, 230B and 330B of the housing 30, 230 and 330. In one (1) embodiment, the housing 30, 230 and 330 is a metal sleeve. In one (1) embodiment, the housing 30, 230 and 330 is constructed of 26 gauge sheet metal.

In the first embodiment, the first end 30A of the housing 30 of the firestop extension 28 is provided with squared J-shaped slots 30D which correspond to the fasteners 26 in the coupling 24 of the base 18 (FIG. 1). In this embodiment, to secure the firestop extension 28 to the base 18, the firestop extension 28 is inserted into the second end 24B of the coupling 24 so that the second end 26B of the fasteners 26 is aligned with the vertical, first portion of the slots 30D in the housing 30. The firestop extension 28 is moved into the coupling 24 until the firestop extension 28 is correctly positioned in the coupling 24. In one (1) embodiment, the firestop extension 28 is correctly positioned when the first end 30A of the housing 30 contacts the shoulder in the inner passageway 24C of the coupling 24 adjacent the first end 24A of the coupling 24. The firestop extension 28 is then rotated to move the first end 26A of the fasteners 26 into the second, essentially horizontal portion of the slots 30D in the housing 30. In one (1) embodiment, the slots 30D are configured so that the housing 30 is rotated in the clockwise direction to lock the firestop extension 28 in place in the base 18. The housing 30 of the firestop extension 28 is then pulled slightly so that the fasteners 26 move into the third, essentially vertical portion of the slots 30D. The engagement of the fasteners 26 in the third portion of the slots 30D locks the firestop extension 28 in place in the base 18. To remove the firestop extension 28 from the coupling 24, the housing 30 is moved inward toward the drain 12 which moves the fasteners 26 out of the third portion of the slots 30D. The housing 30 is rotated so that the fasteners 26 are moved along the second portion of the slots 30D to the first part of the slots 30D. The firestop extension 28 is then pulled out of the coupling 24. The use of fasteners 26 allows the firestop extension 28 to be mounted to the base 18 after the base 18 is mounted in the concrete floor 100. Once the firestop extension 28 is correctly attached to the base 18, the firestop extension 28 extends downward out of the coupling 20 and beyond the second side 100B of the floor 100.

In the second embodiment, the first end 230A of the housing 230 of the firestop extension 228 is securely mounted in the coupling 224. In this embodiment, the housing 230 is secured to the coupling 220 before the base 218 is mounted in the concrete floor 200. Similar to the first embodiment, once the base 218 is mounted in the floor 200, the firestop extension 228 extends downward out of the second end 220B of the coupling 220 and beyond the side 200B of the floor 200.

In the third embodiment, the first end 330A of the housing 330 of the firestop extension 328 is connected directly to the second end 320B of the mounting flange 320. The firestop extension 328 extends from the mounting flange 320 through the floor 300 and beyond the side 300B of the floor 300.

The drain pipe 34 has opposed first and second ends 34A and 34B with the first end 34A secured to the base 18, 218 or 318. The drain pipe 34 extends from the base 18, 218 or 318, through the inner passageway 30C, 230C and 330C of the housing 30, 230 and 330 of the firestop extension 28, 228 and 328 and beyond the second end 30B, 230B and 330B of the housing 30, 230 and 330 of the firestop extension 28, 228 and 328. The second end 34B of the drain pipe 34 is connected to the drain system (not shown). In one (1) embodiment, the drain pipe 34 has an essentially cylindrical shape. The drain pipe 34 is constructed of any well known material used in drainage systems. In one (1) embodiment, the drain pipe 34 is constructed of plastic. In one (1) embodiment, the drain pipe 34 is constructed of polyvinyl chloride (PVC).

In the first embodiment, the first end 34A of the drain pipe 34 is secured in the inner passageway of the coupling sleeve 22. The drain pipe 34 extends downward from the coupling sleeve 22 through the inner passageway 24C of the coupling 24 and through the inner passageway 30C of the housing 30 of the firestop extension 28 and beyond the second end 30B of the housing 30 of the firestop extension 28.

As in the first embodiment, in the second embodiment, the first end 34A of the drain pipe 34 is mounted in the inner passageway of the coupling sleeve 222 and the drain pipe 34 extends downward through the coupling 224 and beyond the second end 230B of the housing 230 of the firestop extension 228.

In the third embodiment, the first end 34A of the drain pipe 34 is secured in the inner passageway of the coupling sleeve 322. The drain pipe 34 extends from the coupling sleeve 322 through the firestop extension 328 and beyond the second end 330B of the housing 330 of the firestop extension 328.

The length and size of the housing 30, 230 and 330 of the firestop extension 28, 228 and 328 depends on the size of the drain pipe 34 and the thickness of the partition 100, 200 or 300. In one (1) embodiment, the length, thickness and rate of expansion of the firestop material 32, 232 and 332 is dependent on the size and length of the housing 30, 230 and 330 of the firestop extension 28, 228 and 328 and the size of the drain pipe 34. The size of the drain pipe 34 is dependent on the size of the drain 12. In one (1) embodiment, for a 2-inch drain 12, the drain pipe 34 is cylindrical and has an inner diameter of approximately 2.0 inches (50.8 mm) and an outer diameter of approximately 2.375 inches (60.325 mm). In one (1) embodiment, for a 3-inch drain, the drain pipe 34 is cylindrical and has an inner diameter of approximately 3.0 inches (76.2 mm) and an outer diameter of approximately 3.5 inches (89.9 mm). In one (1) embodiment, for a 2-inch drain 12, the housing 30, 230 and 330 of the firestop extension 28, 228 and 328 is cylindrical and has an inner diameter of approximately 4.5 inches (114.3 mm) and the firestop material 32, 232 and 332 has a length of approximately 2.0 inches (50.8 mm) and a thickness of approximately 0.375 inches (9.525 mm). In one (1) embodiment, for a 3-inch drain 12, the housing 30, 230 and 330 of the firestop extension 28, 228 and 328 is cylindrical and has an inner diameter of approximately 6.0 inches (152.4 mm) and the firestop material 32, 232 and 332 has a length of approximately 2.0 inches (50.8 mm) and a thickness of approximately 0.625 inches (15.875 mm). The diameter of the inner passageway 30C, 230C and 330C of the housing 30, 230 and 330 of the firestop extension 28, 228 and 328, the diameter of the drain pipe 34, and the thickness of the firestop material 32, 232 and 332 is such that in the initial, unexpanded state, the firestop material 32, 232 and 332 is spaced apart from the outer surface of the drain pipe 34. In one (1) embodiment, for a 2-inch drain the firestop material 32, 232 and 332 is spaced apart from the drain pipe 34 approximately 0.6875 inches (17.4625 mm). In one (1) embodiment, for a 3-inch drain, the firestop material 32, 232 and 332 is spaced apart from the drain pipe 34 approximately 0.625 inches (15.875 mm). In one (1) embodiment, the firestop extension 28, 228 and 328 has a length such that the firestop material 32, 232 and 332 extends down beyond the partition or floor 100, 200 and 300 a distance of at least approximately 3.0 inches (76.2 mm). In one (1) embodiment, the firestop material 32, 232 and 332 is intumescent material. In one (1) embodiment, the firestop material 32, 232 and 332 is PROSBO-10 manufactured by Alva-tech of Burlington Township, New Jersey.

In the first embodiment, for an approximately 4.5 inch (114.3 mm) pour, concrete floor 100, the distance between the strainer 16 of the drain 12 and the top of the firestop material 32 is approximately 5.5 inches (139.7 mm). In this embodiment, the firestop drain assembly 10 has an F-rating and a T-rating of two (2) hours.

In the second embodiment, for an approximately 2.5 inch (63.5 mm) concrete floor 200 on a fluted deck, the distance between the strainer 16 of the drain 12 and the top of the firestop material 232 is approximately 3.5 inches (89.9 mm). In this embodiment, the firestop drain assembly 210 has an F-rating and a T-rating of one (1) hour.

In the third embodiment, for an approximately 7.5 inch (190.5 mm) precast, hollow core concrete floor 300, the distance between the strainer 16 of the drain 12 and the top of the firestop material 332 is approximately 3.5 inches (89.9 mm). In this embodiment the firestop drain assembly 310 has a F-rating and a T-rating of two (2) hours.

The firestop drain assembly 10, 210 and 310 prevents fire from moving through a partition 100, 200 or 300 by way of the firestop drain assembly 10, 210 and 310. The firestop drain assembly 10, 210 and 310 prevents fire from moving from one side 100B, 200B and 300B of the partition to the other side 100A, 200A and 300A of the partition 100, 200 and 300. Thus, when the partition is a floor, the firestop drain assembly 10, 210 and 310 prevents fire from moving between floors by way of the firestop drain assembly 10, 210 and 310. The firestop drain assembly 10, 210 and 310 also prevents the strainer 16 of the firestop drain assembly 10, 210 and 310 adjacent the one side 100A, 200A and 300A of the partition 100, 200 and 300 from increasing in temperature greater than approximately 325° F. (163° C.) above the ambient temperature when fire is adjacent the other side 100B, 200B and 300B of the partition 100, 200 and 300. The ambient temperature of the strainer 16 is the temperature of the strainer 16 before the firestop drain assembly 10, 210 and 310 is exposed to fire.

To secure the firestop drain assembly 10, 210 and 310 in the partition 100, 200 and 300, the base 18, 218 and 318, with or without the firestop extension 28, 228 and 328 attached is mounted in the floor 100, 200 and 300. If mounted without the firestop extension 28, the firestop extension 28 is attached after the floor 100 is poured. The drain 12 is then attached to the mounting flange 20, 220 and 320 of the base 18, 218 and 318 and the drain pipe 34 of the firestop drain assembly 10, 210 and 310 is connected into the remaining drainage system. The firestop drain assembly 10, 210 and 310 is now ready for use.

Figure 5:
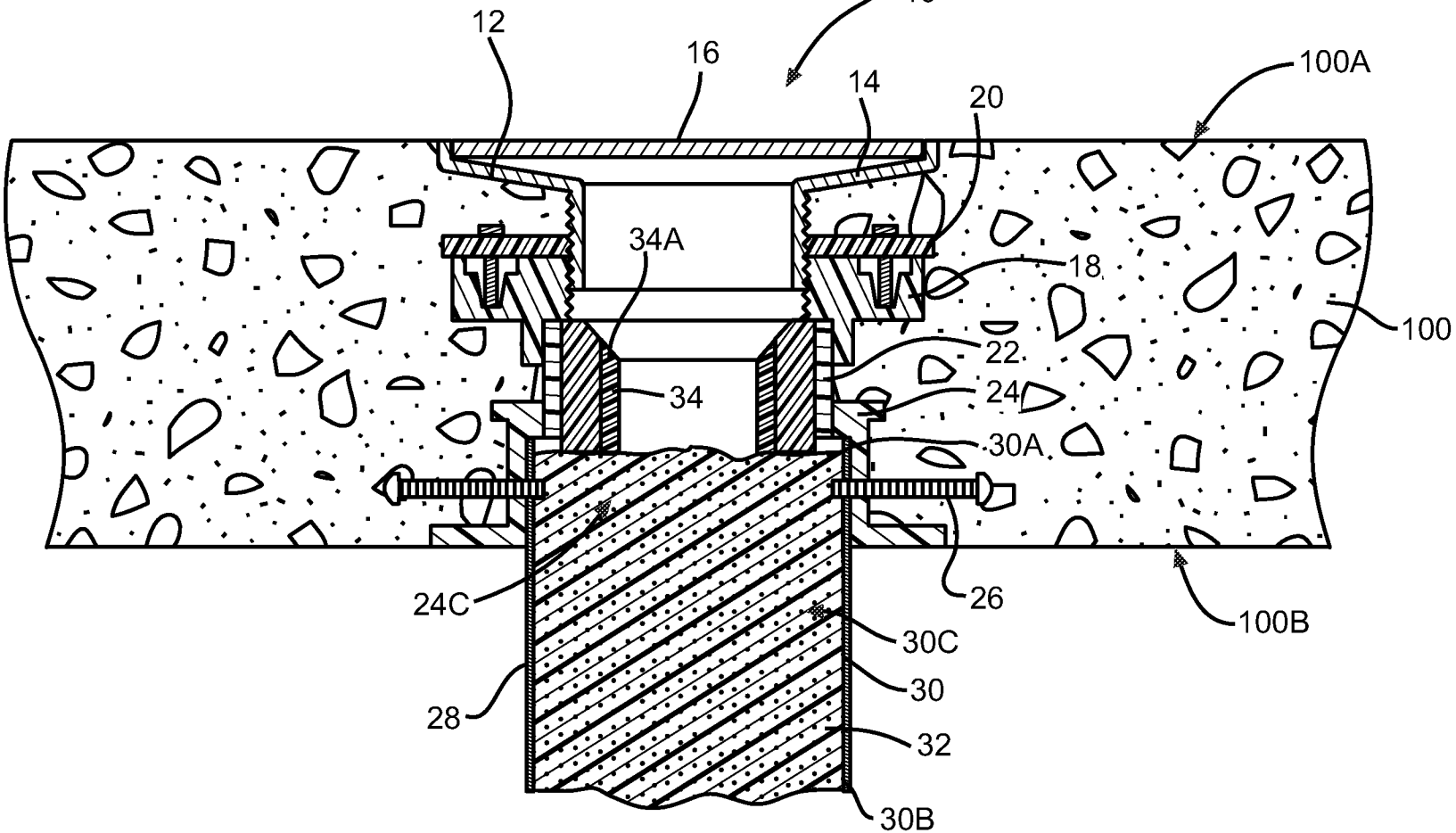
FIG. 5 is a crossectional view of the first embodiment of the firestop drain assembly 10 mounted in a wood form, concrete floor 100 after the firestop drain assembly 10 has been exposed to fire.

In use, when fire is adjacent the one side 100B, 200B and 300B of the partition 100, 200 and 300, the fire contacts the firestop extension 28, 228 and 328 and the heat from the fire causes the firestop material 32, 232 and 332 to expand. The location of the firestop material 32, 232 and 332 beyond the one side 100B, 200B and 300B of the partition 100, 200 and 300 enables the firestop material 32, 232 and 332 to be exposed to the heat of the fire sooner and to expand. The construction of the housing 30, 230 and 330 of the firestop extension 28, 228 and 328 assists in enabling the heat from the fire to reach the firestop material 32, 232 and 332 while at the same time containing the firestop material 32, 232 and 332 in the inner passageway 30C, 230C and 330C of the housing 30, 230 and 330 of the firestop extension 28, 228 and 328. In one (1) embodiment, the firestop extension 28, 228 and 328 extends at least approximately 3.0 inches (76.2 mm) beyond the one side 100B, 200B and 300B of the floor 100, 200 and 300 and the firestop material 32, 232 and 332 is spaced at least approximately one (1) inch below the one side 100B, 200B and 300B of the floor 100, 200 and 300. In one (1) embodiment, all of the firestop material 32, 232 and 332 is located beyond the one side 100B, 200B and 300B of the partition 100, 200 and 300. The heat of the fire adjacent the one side 100B, 200B and 300B of the partition 100, 200 and 300 also causes the drain pipe 34 to soften or melt. The location of the firestop material 32, 232 and 332 spaced below the second side 100B, 200B and 300B of the partition 100, 200 and 300 and spaced apart from the outer surface of the drain pipe 34 in the inner passageway 30C, 230C and 330C of the housing 30, 230 and 330 of the firestop extension 28, 228 and 328 allows the portion of the drain pipe 34 in the inner passageway 30C, 230C and 330C of the housing 30, 230 and 330 of the firestop extension 28, 228 and 328 to soften or melt such that when the expanding firestop material 32, 232 and 332 contacts the drain pipe 34, the firestop material 32, 232 and 332 can crush the drain pipe 34. The size and rate of expansion of the firestop material 32, 232 and 332, as well as the size and construction of the housing 30, 230 and 330 of the firestop extension 28, 228 and 328 enables the portion of the drain pipe 34 located in the inner passageway 30C, 230C and 330C of the housing 30, 230 and 330 of the firestop extension 28, 228 and 328 to be exposed to the heat of the fire so that the heat softens the drain pipe 34 allowing the expanding firestop material 32, 232 and 332 to crush the drain pipe 34. By crushing the drain pipe 34, the firestop material 32, 232 and 332 is able to completely close or block the inner passageway 30C, 230C and 330C of the housing 30, 230 and 330 of the firestop extension 28, 228 and 328 and prevent fire and the heat of the fire from moving through the firestop drain assembly 10, 210 and 310 to the other side 100A, 200A or 300A of the partition 100, 200 and 300. The firestop material 32, 232 and 332 expands until the inner passageway 30C, 230C and 330C of the housing 30, 230 and 330 of the firestop extension 28, 228 and 328 is completely blocked. In one (1) embodiment, the firestop material 32, 232 and 332 expands to completely fill the inner passageway 30C, 230C and 330 of the housing 30, 230 and 330 of the firestop extension 28, 228 and 328 and the inner passageway 20C, 220C and 320C of the coupling 20, 220 and 320 (FIG. 5). The length and diameter of the housing 30, 230 and 330 of the firestop extension 28, 228 and 328 and the thickness, length and rate of expansion of the firestop material 32, 232 and 332 is selected so that after the firestop drain assembly 10, 210 and 310 is exposed to fire adjacent the one side 100B, 200B and 300B of the partition 100, 200 and 300 for at least one (1) hour, the temperature of the strainer 16 adjacent the other side 100A, 200A and 300A of the partition 100, 200 and 300 is less than approximately 325° F. (163° C.) above the ambient temperature of the strainer 16 before the fire. Thus, the firestop drain assembly 10, 210 and 310 is able to obtain an F-rating and a T-rating of at least one (1) hour. In one (1) embodiment, after one (1) hour of being exposed to temperatures of approximately 1850° F. (1010° C.) adjacent the one side 100B, 200B and 300B of the partition 100, 200 and 300, the temperature of the strainer 16 adjacent the other side 100A, 200A and 300A is less than approximately 95° F. (35° C.) greater than the ambient temperature of the strainer 16 before the fire.

In the foregoing description, various features of the present invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated by reference herein in their entirety, with each claim standing on its own as a separate embodiment of the present invention.

It is intended that the foregoing description be only illustrative of the present invention and that the present invention be limited only by the hereinafter appended claims.

I claim:

1. A firestop drain assembly for use in a partition having a first side and a second side, which comprises:

a) a base configured to be mounted in the partition;

b) a strainer connected to the base and configured to be adjacent the second side of the partition;

c) a firestop extension housing having opposed first and second ends with an inner passageway extending therebetween and having a length between the first and second ends, and connected at the first end to the base and extending outward from the base to the second end in a direction opposite the strainer;

d) a drain pipe connected to the base and extending outward from the base through the inner passageway of the firestop extension housing and beyond the second end of the firestop extension housing and configured to extend beyond the first side of the partition in the direction opposite the strainer; and e) firestop material positioned in the inner passageway of the firestop extension housing adjacent the second end of the firestop extension housing, such that in use, when the base is mounted in the partition, all of the firestop material is located beyond the first side of the partition in the direction opposite the strainer, the firestop material having a length, thickness and rate of expansion such that when the drain assembly is mounted in the partition and the first side of the partition is exposed to fire, a portion of the drain pipe located in the inner passageway of the fire extension housing melts before the firestop material expands into contact with the portion of the drain pipe located in the inner passageway of the firestop extension and having a length, thickness and rate of expansion such that the firestop material expands to seal the inner passageway of the firestop extension housing before a temperature of the strainer is greater than approximately 325° F. (163° C.) above an ambient temperature of the strainer so that the drain assembly has a T-rating of at least one hour.

2. The firestop drain assembly of claim 1, wherein a size of the inner passageway of the firestop extension housing is greater than a size of the drain pipe and, wherein the thickness of the firestop material is less than a distance between the drain pipe and the inner passageway of the firestop extension so that the firestop material is spaced apart from the drain pipe.

3. The firestop drain assembly of claim 2, wherein the drain pipe has a cylindrical shape and the inner passageway of the firestop extension housing has an essentially cylindrical shape, wherein an outer diameter of the drain pipe is approximately 2.375 inches (60.325 mm), a diameter of the inner passageway of the firestop extension housing is approximately 4.5 inches (114.3 mm) and the thickness of the firestop material is at least approximately 0.375 inches (9.525 mm).

4. The firestop drain assembly of claim 3, wherein the length of the firestop material is at least approximately 2.0 inches (50.8 mm) so that the firestop material extends along the inner passageway of the firestop extension housing a distance of at least approximately 2.0 inches (50.8 mm).

5. The firestop drain assembly of claim 4, wherein the firestop material is spaced apart from the strainer a distance of at least approximately 3.5 inches (89.9 mm).

6. The firestop drain assembly of claim 2, wherein the drain pipe has a cylindrical shape and the inner passageway of the firestop extension housing has an essentially cylindrical shape wherein an outer diameter of the drain pipe is approximately 3.5 inches (89.9 mm), a diameter of inner passageway of the firestop extension housing is approximately 6.0 inches (152.4 mm), and the thickness of the firestop material is at least approximately 0.625 inches (15.875 mm).

7. The firestop drain assembly of claim 6, wherein the length of the firestop material is at least approximately 2.0 inches (50.8 mm) so that the firestop material extends along the inner passageway of the firestop extension housing a distance of at least approximately 2.0 inches (50.8 mm).

8. The firestop drain assembly of claim 7, wherein the firestop material is spaced apart from the strainer a distance of at least approximately 3.5 inches (89.9 mm).

9. The firestop drain assembly of claim 1, wherein the drain pipe has a cylindrical shape and the inner passageway of the firestop extension housing has an essentially cylindrical shape, and wherein an outer diameter of the drain pipe is approximately 2.375 inches (60.325 mm), a diameter of the inner passageway of the firestop extension housing is approximately 4.5 inches (114.3 mm) and the thickness of the firestop material is at least approximately 0.375 inches (9.525 mm).

10. The firestop drain assembly of claim 1, wherein the drain pipe has a cylindrical shape and the inner passageway of the firestop extension housing has an essentially cylindrical shape, and wherein an outer diameter of the drain pipe is approximately 3.5 inches (89.9 mm), a diameter of inner passageway of the firestop extension housing is approximately 6.0 inches (152.4 mm), and the thickness of the firestop material is at least approximately 0.625 inches (15.875 mm).

11. The firestop drain assembly of claim 1, wherein the strainer is constructed of metal, the drain pipe is constructed of plastic, the firestop extension housing is constructed of metal and the firestop material is an intumescent material.

12. The firestop drain assembly of claim 11, wherein the drain pipe has a cylindrical shape and the inner passageway of the firestop extension housing has an essentially cylindrical shape, and wherein an outer diameter of the drain pipe is approximately 2.375 inches (60.325 mm), a diameter of the inner passageway of the firestop extension housing is approximately 4.5 inches (114.3 mm) and the thickness of the firestop material is at least approximately 0.375 inches (9.525 mm).

13. The firestop drain assembly of claim 11, wherein the drain pipe has a cylindrical shape and the inner passageway of the firestop extension housing has an essentially cylindrical shape, and wherein an outer diameter of the drain pipe is approximately 3.5 inches (89.9 mm), a diameter of inner passageway of the firestop extension housing is approximately 6.0 inches (152.4 mm), and the thickness of the firestop material is at least approximately 0.625 inches (15.875 mm).

14. The firestop drain assembly of claim 1, wherein the length of the firestop extension housing is such that in use when the drain is mounted in the partition, the firestop extension extends beyond the first side of the partition, in the direction opposite the strainer, a distance of at least approximately 3.0 inches (76.2 mm).

15. The firestop drain assembly of claim 1, wherein the firestop material is spaced apart from the strainer a distance of at least approximately 3.5 inches (89.9 mm).

16. The firestop drain assembly of claim 1, wherein the length of the firestop material is at least approximately 2.0 inches (50.8 mm) so that the firestop material extends along the inner passageway of the firestop extension housing a distance of at least approximately 2.0 inches (50.8 mm).

17. The firestop drain assembly of claim 1, wherein the partition is a concrete floor constructed using a wood form, wherein, the base is provided with fasteners which extend into an inner passageway of the base and outward from the base into the concrete, wherein the firestop extension housing has slots and the firestop extension housing is connected to the base by the fasteners which extend into the slots to lock the firestop extension housing in position in the inner passageway of the base.

18. The firestop drain assembly of claim 1, wherein the firestop extension housing is removably connected at the first end to the base.

19. The firestop drain assembly of claim 18, wherein the base has a coupling, fasteners are mounted in the coupling and extend into an inner passageway of the coupling, and the firestop extension has slots adjacent the first end, and the fasteners extend into the slots.

20. The firestop drain assembly of claim 19, wherein the slots of the firestop extension have an essentially J-shape with an essentially vertical first portion, an essentially horizontal second portion and an essentially vertical third portion.

21. A firestop drain assembly for use in preventing fire adjacent a first side of a partition from moving through the partition to a second side of the partition, which comprises:

a) a base having opposed first and second ends and configured to be mounted in the partition;

b) a drain housing having opposed ends and connected at one end to the first end of the base;

c) a strainer mounted on the opposed end of the drain housing spaced apart from the base;

d) a firestop extension housing having opposed first and second ends with an inner passageway extending therebetween connected at the first end to the second end of the base and extending outward from the base to the second end of the firestop extension housing in a direction opposite the strainer;

e) a drain pipe connected to the second end of the base and extending outward from the base through the inner passageway of the firestop extension housing and beyond the second end of the firestop extension housing in the direction opposite the strainer; and f) firestop material positioned in the firestop extension housing spaced apart from the base and the strainer such that in use when the base is mounted in the partition, all of the firestop material is located beyond the first side of the partition spaced apart from the first side of the partition and the firestop material having a length, thickness, and rate of expansion such that when the first side of the partition is exposed to fire, a portion of the drain pipe located in the inner passageway of the firestop extension housing melts before the firestop material expands into contact with the portion of the drain pipe located in the inner passageway of the firestop extension and the firestop material expands to seal the inner passageway of the firestop extension housing before a temperature of the strainer is greater than approximately 325° F. (163° C.) above an ambient temperature of the strainer so that the drain assembly has a T-rating of at least one hour.

* * * * *